United States Patent [19]

Peters

[11] 4,289,107

[45] Sep. 15, 1981

[54] ENGINE CARBURETOR THROTTLE BLADE POSITIONING CONTROL

[75] Inventor: Douglas J. Peters, Livonia, Mich.

[73] Assignee: Ford Motor Company, Dearborn, Mich.

[21] Appl. No.: 107,979

[22] Filed: Dec. 28, 1979

[51] Int. Cl.[3] ..... F02M 25/06; F02M 3/00

[52] U.S. Cl. ..... 123/571; 123/339; 123/328

[58] Field of Search ..... 123/571, 568, 570, 339, 123/328

[56] References Cited

U.S. PATENT DOCUMENTS

| | | | |
|---|---|---|---|
| 3,647,016 | 3/1972 | Fitzsimons et al. | 123/339 |
| 3,753,427 | 8/1973 | Cedar | 123/328 X |
| 3,930,475 | 1/1976 | Lewis et al. | 123/568 |

FOREIGN PATENT DOCUMENTS

| | | | |
|---|---|---|---|
| 52-48732 | 4/1977 | Japan | 123/568 |
| 54-3623 | 1/1979 | Japan | 123/568 |
| 54-8228 | 1/1979 | Japan | 123/568 |
| 54-150522 | 11/1979 | Japan | 123/339 |
| 54-155317 | 12/1979 | Japan | 123/339 |
| 2035453 | 6/1980 | United Kingdom | 123/571 |

*Primary Examiner*—Wendell E. Burns
*Attorney, Agent, or Firm*—Robert E. McCollum; Clifford L. Sadler

[57] ABSTRACT

The throttle valve of an automotive engine carburetor is positioned at times by a vacuum servo means to maintain or establish a predetermined engine idle speed rpm. The engine exhaust gas recirculation (EGR) valve is also controlled by a vacuum servo means to schedule EGR flow. The two servo means time share the vacuum by means of a computer controlled type electronic control so that when the throttle valve is in closed throttle idle speed position, the EGR servo means is not controlled, and when the throttle valve is in an off-idle setting, the EGR servo means is operative and the throttle valve servo means not.

8 Claims, 4 Drawing Figures

ENGINE CARBURETOR THROTTLE BLADE POSITIONING CONTROL

This invention relates in general to a control for an automotive type internal combustion engine. More particularly, it relates to one for controlling the idle speed of the engine in conjunction with the operation of the engine exhaust gas recirculation (EGR) valve.

The conventional automotive type internal combustion engine carburetor generally has a single engine idle speed closed throttle position that is usually preset at the factory. This particular idle speed is usually a compromise between one that is low enough to provide the best fuel economy operation and low exhaust emission levels, and yet one that is high enough to prevent the engine from stalling even with the indiscriminate cutting in and out of accessory units such as air conditioning systems. This compromise, however usually results in more mass fuel flow at certain times than is necessary for continued operation of the engine.

This invention relates to a control for automatically varying the idle speed setting of the carburetor by automatically varying the closed throttle position of the carburetor throttle valve in response to various operating conditions of the engine.

It is, therefore, a primary object of the invention to provide an automotive engine idle speed control that variably positions the carburetor throttle valve to maintain a predetermined idle speed rpm of the engine while at the same time controlling the actuation of the engine EGR valve, in a manner to provide simplification of parts, construction and operation.

Control of the idle speed of the engine to vary in accordance with operating conditions of the engine is known. For example, U.S. Pat. No. 3,647,016, Fitzsimons et al, assigned to the assignee of this application, shows in FIG. 4 a carburetor throttle valve positioner consisting of a servo mechanism that is supplied with vacuum through a valving controlled by a computer mechanism responsive to various operations of the engine to move the carburetor throttle plate to different positions.

U.S. Pat. No. 3,753,427, Cedar, also assigned to the assignee of this invention, shows in more detail a combination servo mechanism and dashpot controlled by carburetor intake manifold vaccum to position the carburetor throttle plate for different idle speed operation conditions.

U.S. Pat. No. 3,930,475, Lewis et al also assigned to the assignee of this invention, shows and describes an engine EGR system having a spring closed EGR valve by carburetor ported intake manifold vacuum to circulate exhaust gases from the exhaust manifold back into the intake manifold of the engine to reduce $NO_x$.

In each of the above instances, it will be noted that a separate servo mechanism is required for each of the operations desired. Also, in each instance, a separate control is needed for directing vacuum to each individual servo for subsequent actuation thereof.

This invention relates to a control for the throttle valve of a carburetor that is combined with the control for an EGR valve so that only one is operative at any one time. Since EGR flow generally is scheduled only when the engine is partially under load, when the carburetor throttle plate is closed or in its idle speed position, the idle speed servo will be actuatable while the EGR servo will not, and when the throttle is in its off-idle or part-throttle setting, the EGR servo will be actuable, and the idle speed control servo not.

The control of this invention also includes a pulse-width or similar control type computer or microprocessor that is responsive to various operating conditions of the engine to selectively control the energization of solenoid controlled valves to control the flow of vacuum alternately to the EGR valve servo and to the throttle valve positioner servo.

It is another object of the invention, therefore, to provide a control for an engine carburetor throttle plate positioner and an EGR valve that includes electrically actuated solenoid valves that are time shared between the EGR valve and the idle speed throttle valve positioner.

It is a still further object of the invention to provide a control of the type described including a pair of solenoid operated valves that are alternately actuated to alternately supply vacuum to a carburetor throttle valve positioning servo or an EGR servo, to reduce costs and simplify the construction by controlling both the EGR servo and the throttle valve positioning servo with one set of hardware.

Other objects, features and advantages of the invention will become more apparent upon reference to the succeeding detailed description thereof and to the drawings illustrating the preferred embodiment; wherein, FIG. 1 is a cross sectional view of a portion of a downdraft type carburetor embodying the invention;

Figure 1:
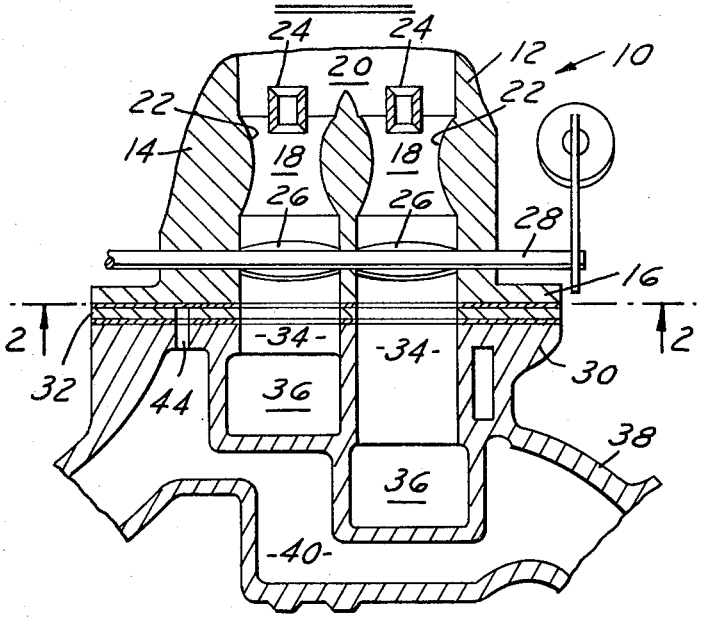

FIG. 1 illustrates a portion 10 of a two-barrel carburetor of a known downdraft type. It has an air horn section 12, a main body portion 14, and a throttle body 16. It also has the usual air/fuel induction passages 18 open at their upper ends 20 to fresh air from the conventional air cleaner, not shown. The passages 18 have the usual fixed are venturies 22 cooperating with booster venturies 24 through which the main supply of fuel is induced, in a known manner.

Flow of air and fuel through induction passages 18 is controlled by a pair of throttle valve plates 26 each fixed on a shaft 28 rotatably mounted in the side walls of the carburetor body.

The throttle body 16 is flanged as indicated for bolting to the top of the engine intake manifold 30, with a spacer element 32 located between. Manifold 30 has a number of vertical risers or bores 34 that are aligned for cooperation with the discharge end of the caburetor induction passages 18. The risers 34 extend at right angles at their lower ends 36 for passage of the mixture out of the plane of the figure to the intake valves of the engine.

The exhaust manifolding part of the engine cylinder head is indicated partially at 38, and includes an exhaust gas crossover passage 40. The latter passes from the exhaust manifold, not shown, on one side of the engine to the opposite side beneath the manifold trunks 36 to provide the usual "hot spot" beneath the carburetor to better vaporize the air/fuel mixture.

Figure 2:
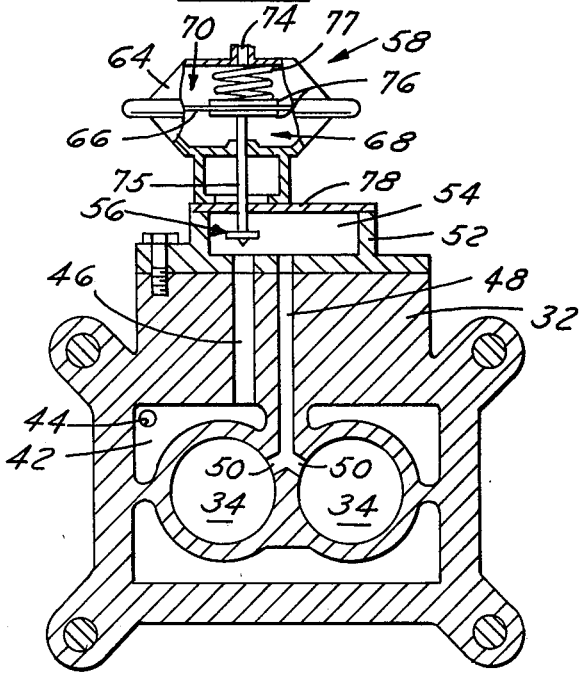
FIG. 2 is a cross sectional view taken on a plane indicated by and viewed in the direction by the arrows 2—2 of FIG. 1.

As best seen in FIG. 2, the spacer 32 is provided with a worm-like recess 42 that is connected directly to crossover passage 40 by a bore 44. Also connected to passage 42 is a passage 46 alternately blocked or connected to a central bore or passage 48 communicating with the risers 34 through a pair of ports 50. Mounted to one side of the spacer is a cup shaped boss 52 forming a chamber 54 through which passages 46 and 48 are interconnected.

Passage 46 normally is closed by a valve 56 that is moved to an open position by a servo 58. The servo includes a hollow outer shell 64 containing an annular flexible diaphragm 66. The latter divides the interior into an air chamber 68 and a signal vacuum chamber 70. Chamber 68 is connected to atmospheric pressure through a vent not shown, while chamber 70 is connected to a vacuum signal force through a line 74. The stem 75 of valve 56 is fixed to a pair of retainers 76 secured to diaphragm 66. They serve as a seat for a compression spring 77 normally biasing the valve to its closed position. The stem slidably and sealingly projects through a plate 78 closing chamber 54.

Figure 3:
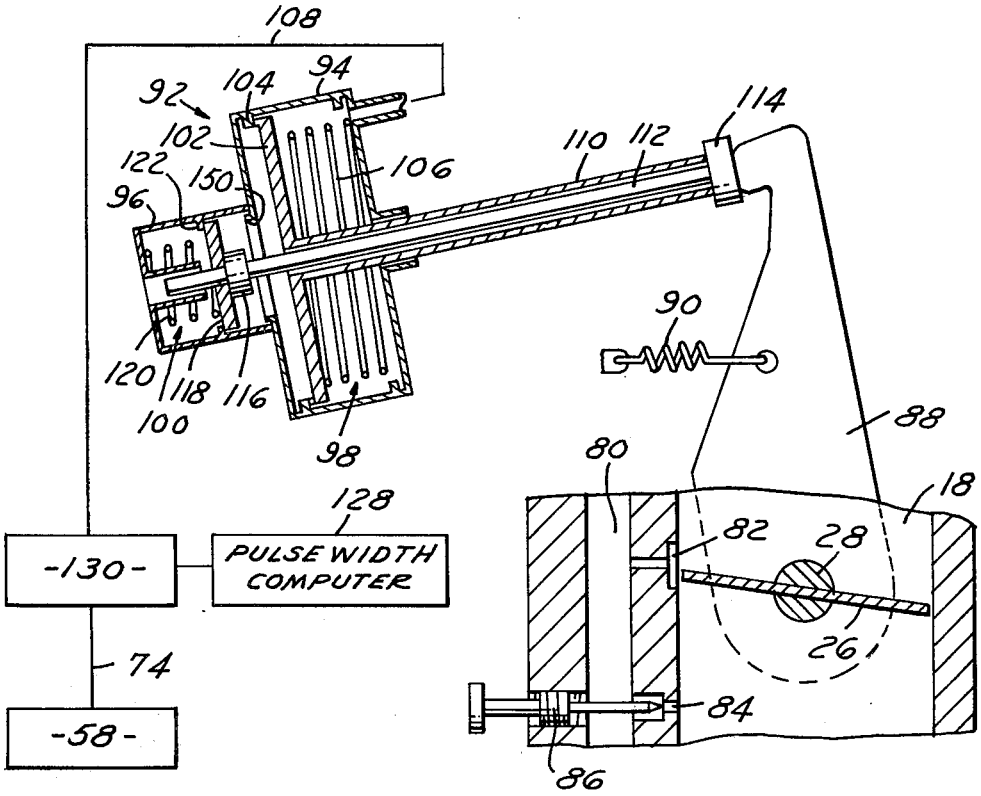
FIG. 3 is an enlarged schematic view of a portion of the FIG. 1 showing; and, FIG. 4 is a schematic representation of a control system for the operating elements shown in the previous figures.

Referring to FIG. 3, as stated previously, the flow of air and fuel through induction passage 20 is controlled by a conventional throttle valve or plate 26. A main fuel system is not shown, since it may be any of many known types. Suffice it to say that the fuel would be inducted into passage 18 from above the throttle valve in a known manner as a function of the rotation of the valve from its closed idle speed position shown to a wide open nearly vertical position, by the change in engine manifold vacuum signal.

The carburetor also contains a conventional idle system for supplying the necessary fuel and air to the engine cylinders around the throttle valve during engine idling and off idle speed operation. A bypass passage or channel 80 contains the usual transfer port 82 and a discharge port 84 controlled by an adjustable needle valve 86.

The transfer port 82 is located so that it straddles the edge of the throttle valve plate in its minimum idle speed position shown. Alternatively, if desired, the transfer port can be located vertically in other positions relative to the throttle plate edge.

It will be clear that in the position shown, the area of the transfer port 82 above the throttle valve edge subjects passages 18 to an ambient or atmospheric pressure air bleed. The quantity flowable past the needle valve at this time will be selected to be sufficient to provide the torque necessary to overcome the engine friction and prevent stall.

It will also be seen that when the throttle valve is moved more open, the transfer port area subjected to the vacuum signal below the throttle valve is increased so as to increase the amount of idle system fuel and air to complement the increased main air flow passages 18.

As stated previously, the invention provides a servo device that will position the throttle valve at various settings to maintain or establish a desired engine rpm regardless of the load imposed on the engine at idle. To accomplish this, a lever or link 88 is fixed on throttle valve shaft 28 for rotation with it, a tension spring 90 biasing lever 88 in a counterclockwise closed throttle valve direction. Lever 88 is adapted to be moved clockwise to the right from the position shown in FIG. 3, by a servo 92.

The servo 92 comprises a hollow two-piece housing 94 and 96, defining, respectively, a vacuum chamber 98 and a dashpot air chamber 100. An annular piston 102 is sealingly and slidably movable within chamber 98, and is pressed against an annular stop 104 by a spring 106. A vacuum line 108 admits vacuum from any suitable source to chamber 98 to move the piston rightwardly as seen in FIG. 3 against the force of spring 106.

The piston 102 is formed with a hollow stem 110 through which is slidably mounted plunger or rod 112. One end of rod 112 is provided with a pad 114 for engagement at times with the end of the throttle lever 88. The opposite end of rod 112 is formed with a land 116 serving as an abuttment for an annular disc-type damper or dashpot plate 118. The latter is biased against land 116 by a light spring 120. A small bleed orifice, not shown, vents air chamber 100 to the atmosphere at a controlled rate to provide the dashpot action to be described. An annular stop 122 limits the movement of the dashpot member 118 in the leftward direction as seen in FIG. 3.

The positions of the elements shown in FIG. 3 are obtained when the engine is off in a loaded condition. That is, the tension of spring 90 will pull throttle lever 88 to engage the end 114 of plunger rod 112 and push the same leftwardly until the dashpot disc 118 stops against the stop 122. The slow bleed of air from chamber 100 will cause the dashpot action. When the engine is started and the throttle lever 88 rotated to open the throttle valve, the release of force on the end of plunger rod 112 will permit the spring 120 to move the damper plate 118 and also the plunger rod 112 rightwardly to its no load position. Other positions of the plunger will be caused by selectively admitting vacuum to chamber 98 to pull the piston 102 rightwardly until the end of the hollow stem abuts the plunger end 114 and moves it rightwardly to a particular stopped position of the throttle lever 88 that will provide the correct fuel air flow to establish the desired engine idle speed rpm. This will be explained more fully later. The flow of vacuum in this case is controlled by a pulsewidth type computer or microprocessor indicated in general at 128 that energizes and deenergizes selected parts of an electrical control unit 130 in response to various input signals indicative of the operating conditions of the engine to selectively admit vacuum at varying levels and for various durations to the vacuum chamber 98, or alternatively to the EGR servo 58.

Figure 4:
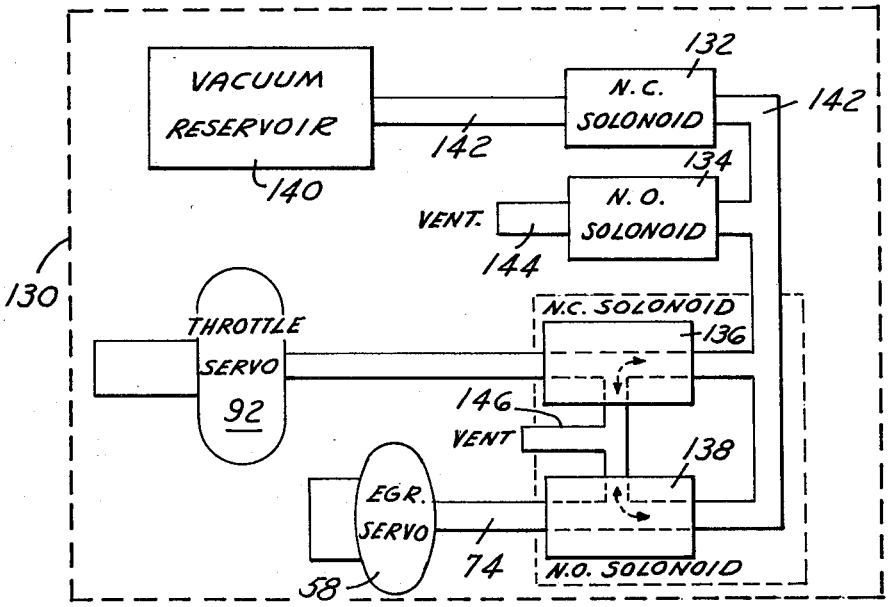

Control 130 is schematically illustrated in more detail in FIG. 4. It consists of an electrical system including four solenoid controlled valves 132, 134, 136, 138 that control the supply of vacuum from a vacuum reservoir 140 and a main line 142. Solenoid valve 132 is a normally spring closed, (NC) electrically opened type, while solenoid valve 134 is a normally spring opened (NO), electrically closed type to control the vent of vacuum through a line 144. The two solenoid valves 136, 138 respectively control the flow of vacuum to the throttle servo 92 or the EGR servo 58, or vent these servo lines through a line 146. The solenoid valve 136 is normally spring closed (NC) to block flow of vacuum from the main line 142 to branch line 108 while venting the branch line 108 to the vent line 146. The other solenoid valve 138 is normally spring open (NO) when deenergized to connect the EGR servo supply line 74 to the main vent line 146, while blocking the flow of vacuum from the main line 142.

As stated previously, the throttle servo 92 and the EGR servo 58 are adapted to time share the vacuum. When the throttle valve is in its idle speed position, no EGR flow generally is desired. Therefore, when the throttle valve is in its idle speed position, the EGR solenoid valve 138 should and will be closed while the throttle servo solenoid valve 136 will be opened to supply vacuum to position the throttle valve at the desired engine rpm idle speed position. The solenoid valves 136 and 138 are operated jointly or concurrently at all times, being either both deenergized at once or both energized and that in either condition one of the valves will be open while the other is closed and its line to the servo vented. Vacuum flow to the two servos 92 and 58 is in a parallel flow path relationship with respect to the main line 142.

It will be clear, therefore, that the computer 128 will, depending upon the operating conditions of the engine, energize or deenegized the solenoid valves selectively and for predetermined periods, to determine the vacuum force to be applied or not applied to the servos 58 and 92.

In operation, therefore, assume that the throttle lever 88 is in an open position rotated clockwise from the position shown in FIG. 3, indicating an off idle operating mode condition. Spring 120 will cause the plate 118 to push rod 112 outwardly until the plate seats against the shoulder 150 of housing 94. Simultaneously, the computer sensing the open throttle position will energize only the solenoid valves 132 and 134 to supply vacuum to the EGR servo 58 while vacuum flow is blocked to throttle servo 92. The EGR valve 56 then will be opened an amount in proportion to the load. When it has reached the desired opening, the feedback to the computer will effect a deenergization only of solenoid 132 to cause the EGR valve to hold its position.

If the throttle valve is now permitted to return to its idle speed position by spring 90, it will engage the end 114 of plunger 112 and depress the plunger against the spring 120, obtaining a dashpot action as it returns to its minimum open position. Solenoid valve 124 will be energized to open the vent 144, which will vent the EGR servo and close the EGR valve. If the engine rpm at this setting of the throttle valve is lower than that called for by the computer design level, the computer will now energize solenoid valves 132, 134, 136 and 138, and vacuum will now flow to servo 92. Piston 102 will be moved rightwardly to open the throttle valve to obtain the desired idle speed rpm. When it is obtained only solenoid valve 132 will be deenergized to hold the throttle valve in its new position.

Assume now that an accessory unit such as an air conditioning unit is brought into play, this extra load on the engine may cause the engine rpm to again dip below the idle speed setting called for. The lower rpm sensor signals again received by the computer will then again cause solenoid valve 132 to be energized to admit vacuum from the main line to the branch line 108 and chamber 98 shown in FIG. 3. This will again move the plunger 112 rightwardly to move the throttle lever 88 clockwise and open the throttle valve to increase the flow of fuel and air into the engine. This will result in an increased engine speed which will be sensed by the computer 128. When the desired speed again is reached, the computer again will deenergize the solenoid valve 132, thus interrupting the supply of vacuum to the throttle servo 98 and cause it to hold its position. When again the throttle lever 88 is rotated to an open throttle position, the computer 128 upon receiving this signal, will energize the solenoid valve 132 and deenergize solenoid valves 136 and 138 to vent the servo 92 and admit vacuum to the EGR servo 58 to permit the EGR valve to open to recirculate engine exhaust gases at this time.

From the above, therefore, it will be seen that when the engine is operating in an off idle condition, EGR gases will flow and will flow at a rate as called for by the computer 128. That is, the EGR valve will open to a degree as determined by the engine operating load conditions. Similarly, when the throttle valve is returned to its idle speed position, the computer will sense the engine speed obtained and will cause an adjustment of that speed to the design speed by admitting vacuum to the throttle servo 92. This will move the servo plunger and thereby change the position of the throttle valve to maintain the engine speed at the level desired.

From the foregoing, it will be seen that the invention provides a vacuum control unit for both engine EGR flow and throttle valve idle speed positioning in which the controls for the same are time shared with one another to provide a cost efficient, simple, control device that eliminates duplication of parts and the accomplishment of two objectives through the use of a single set of hardware.

While the invention has been shown and described in its preferred embodiment, it will be clear to those skilled in the art to which it pertains that many changes and modifications may be made thereto without departing from the scope of the invention.

I claim:

1. An engine carburetor throttle valve position control comprising, in combination, a caburetor mounted on an engine and having an induction passage open to atmospheric pressure at one end and adapted to be connected to the engine intake manifold at the opposite end and including a throttle valve rotatably mounted across the passage movable open from an essentially closed throttle engine idle speed position and having a return movement, for controlling flow through the passage, spring means biasing the throttle valve towards the closed position, first vacuum controlled servo means having stop means extending into the path of movement of the throttle valve in a closing direction to predetermine the idle speed position of the throttle valve, passage means connecting a source of vacuum to the servo to vary the position of the stop means and thereby vary the idle speed setting of the throttle valve, an exhaust gas recirculation (EGR) passage means connecting engine exhaust gases to the induction passage below the closed position of the throttle valve, a spring closed, vacuum opened EGR flow control valve mounted in the EGR passage means for a variable movement between open and closed positions to control the volume of EGR gas flow, a second vacuum controlled servo means connected to the EGR valve for moving the EGR valve to an open position, means connecting the second servo means to the passage means, and control means to control flow of vacuum to the first and second servo means to control opening of the EGR valve and to determine the idle speed setting of the throttle valve, the control means comprising a switching means alternately movable to supply vacuum to the first servo means while cutting off flow of vacuum to the second servo means and vice-versa.

2. A control as in claim 1, the switching means being selectively activated.

3. A control as in claim 1, the switching means in one mode of operation supplying vacuum to the first servo means in response to movement of the throttle valve to the closed throttle position while cutting off vacuum to the EGR valve second servo means, and in a second mode cutting off vacuum to the first servo means while supplying vacuum to the second servo means to actuate the EGR valve in response to movement of the throttle valve away from the closed idle speed position.

4. A control as in claim 1, the passage means being connected in parallel flow relationship to the first and second servo means, the passage means including a main line and a vent line connected to the main line, and electrically operated means in each of the main and vent lines controlling the flow of vacuum through and the bleed of air into the main line to control the operation of the first and second servo means.

5. A control as in claim 4, the electrically operated means including a normally closed solenoid in the main passage and a normally open solenoid in the vent line, the solenoids being selectively energized and deenergized at will in response to predetermined conditions of operation of the engine to permit selective application or venting of vacuum to a servo means.

6. A control as in claim 1, the passage means including a main vacuum line connected in parallel flow relationship through a pair of branch lines to the first and second servo means, a spring biased solenoid type valve in each of the branch lines, one of the valves being normally biased open and electrically closed and the other valve being normally biased closed and electrically opened, to supply vacuum alternately to the first and second servo means, and a vent line for the valves for venting one of the servo means when the other servo means is not connected to the vacuum source.

7. A control as in claim 6 including a further pair of spring biased solenoid valves, one of the further pair of valves being in the main vacuum line from the source and being normally biased closed and electrically opened, and the other of the further pair of valves being connected to the main line and a vent line and being normally biased open to vent the main line and being electrically closed, each of the further pair of solenoid valves being selectively and individually electrically energized and deenergized at will, the solenoid valves in the branch lines being selectively energized and deenergized as a pair.

8. A control as in claim 7, including pulsewidth control computer means responsive to electrical signals generated in response to predetermined conditions of operation of the engine to selectively energize and deenergize the solenoid valves and vary the level of vacuum to the servo means to control the idle speed setting of the throttle valve and the variable opening and closing of the EGR valve.

* * * * *